US010550334B1

(12) United States Patent
Xu et al.

(10) Patent No.: US 10,550,334 B1
(45) Date of Patent: Feb. 4, 2020

(54) INCREASING HYDROCRACKER DIESEL YIELD, TOTAL LIQUID YIELD AND POUR POINT PROPERTIES BY AMMONIA OR AMINE SPIKING

(71) Applicant: PHILLIPS 66 COMPANY, Houston, TX (US)

(72) Inventors: Xiaochun Xu, The Woodlands, TX (US); Jianhua Yao, Bartlesville, OK (US)

(73) Assignee: PHILLIPS 66 COMPANY, Houston, TX (US)

( * ) Notice: Subject to any disclaimer, the term of this patent is extended or adjusted under 35 U.S.C. 154(b) by 0 days.

(21) Appl. No.: 16/218,092

(22) Filed: Dec. 12, 2018

(51) Int. Cl.

| | |
|---|---|
| ***C10G 11/20*** | (2006.01) |
| ***C10G 47/36*** | (2006.01) |
| ***C10G 11/18*** | (2006.01) |
| ***C10G 69/04*** | (2006.01) |

(52) U.S. Cl.
CPC ..... *C10G 11/20* (2013.01); *C10G 11/187* (2013.01); *C10G 47/36* (2013.01); *C10G 69/04* (2013.01); *C10G 2300/107* (2013.01); *C10G 2300/1059* (2013.01); *C10G 2300/1074* (2013.01); *C10G 2300/1077* (2013.01); *C10G 2300/705* (2013.01); *C10G 2400/02* (2013.01); *C10G 2400/04* (2013.01)

(58) Field of Classification Search
None
See application file for complete search history.

(56) References Cited

U.S. PATENT DOCUMENTS

| | | | | |
|---|---|---|---|---|
| 3,537,977 | A * | 11/1970 | Smith | C01B 3/36 208/89 |
| 6,948,562 | B2 * | 9/2005 | Wellington | E21B 7/04 137/13 |
| 7,090,013 | B2 * | 8/2006 | Wellington | E21B 41/0064 166/267 |
| 2012/0031811 | A1 * | 2/2012 | Cowan | C10G 45/02 208/57 |

* cited by examiner

*Primary Examiner* — Tam M Nguyen
(74) *Attorney, Agent, or Firm* — Phillips 66 Company

(57) ABSTRACT

A process is disclosed for shifting the product of a hydrocracker in a hydrocarbon refinery back and forth from a more naphtha focused product slate to a more diesel focused product slate to take advantage of price and demand shifts between gasoline and diesel by using a naphtha selective catalyst and temporarily passivating the catalyst with a basic material such as ammonia in the hydrocracker. The ammonia passivates the acid catalyst sites on the catalyst and produces more total liquids and more diesel with attractive cold flow and pour point properties for a temporary period. When implemented in a temporary manner and the flow of ammonia is suspended the hydrocracker product slate returns to a more gasoline focused slate.

19 Claims, No Drawings

INCREASING HYDROCRACKER DIESEL YIELD, TOTAL LIQUID YIELD AND POUR POINT PROPERTIES BY AMMONIA OR AMINE SPIKING

CROSS-REFERENCE TO RELATED APPLICATIONS

None.

STATEMENT REGARDING FEDERALLY SPONSORED RESEARCH OR DEVELOPMENT

None.

FIELD OF THE INVENTION

This invention relates to operating a hydrocracker in a petroleum refinery to produce the most value from the products based on current market prices of products including diesel and naphtha and other refined products.

BACKGROUND OF THE INVENTION

It is generally well known that the US auto fleet uses a higher proportion of gasoline to diesel as compared to most of the rest of the world. As a result, refineries in the US use hydrocrackers to produce naphtha which is a feedstock for other refining processes such as reforming to make gasoline or as gasoline blending stock. In other countries, particularly in Europe and Asia, hydrocrackers are designed and operated to produce diesel and less naphtha. The conditions and feedstock certainly have an impact on the product slate of a hydrocracker, but catalyst selection is probably the most influential driver of product slate.

To the extent that the US diesel market is, at times, oversupplied therefore driving down US diesel prices, excess diesel has often been exported. But, diesel demand in the U.S. has increased by approximately 40% since 1998 and is expected to continue increasing while gasoline demand has been commonly viewed as relatively flat, by comparison. As a result, refiners in North America have been and will be increasingly compelled to evaluate their processing options to expand diesel production. While it would be desirable to quickly alter the catalyst in a hydrocracker to thereby shift naphtha production to increase the net diesel production when prices are favorable, the cost of shutting down the hydrocracker and switch catalyst well exceeds any price opportunity almost regardless of the duration that favorable prices may exist. Indeed, it is most economical to run a hydrocracker as hydraulically full as practical for as long as it is productive before shutting down for a turn around and a new load of catalyst. The catalyst is typically spent at the end of a run. Such a time frame is usually measured in years and the diesel gasoline price advantage generally shifts seasonally to gasoline in the summer and to diesel in the winter.

What is needed is a more adjustable hydrocracker that is suited for producing higher volumes of naphtha and lower volumes of diesel when desired, such as during the summer gasoline production time producing less naphtha and more diesel in the winter or during a time that diesel has a higher profit margin than gasoline.

BRIEF SUMMARY OF THE DISCLOSURE

The invention more particularly relates to process for operating a catalytic hydrocracker in a hydrocarbon refinery wherein a naphtha selective catalyst is selected and installed into a hydrocracker vessel and a hydrocarbon feedstream is delivered into the hydrocracker vessel. The hydrocarbon feedstream is a heavy distillation hydrocarbon material where at least 50% of the feedstream has a boiling point fraction of at least 650° F. Hydrogen is delivered into the hydrocracker vessel where both the hydrocarbon feedstream and the hydrogen are in contact with the catalyst under catalytic conditions to cause both hydrogenation and cracking of the hydrocarbon feedstream which produces a product slate that comprises a first desired naphtha make and a first desired distillate make. The process includes selectively feeding a basic compound in to the hydrocracker to partially passivate the catalyst and to thereby shift the product slate to a ratio where a higher diesel make is produced relative to the naphtha make such that the diesel make is at least 0.5% higher than when the basic compound is not fed to the hydrocracker and selectively suspending the feed of the basic compound to the hydrocracker to shift the product slate back to near the original ratio of diesel make to naphtha make.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Hydrocrackers use hydrogen and catalyst to break carbon-carbon bonds in bigger and heavier feedstock and to make lighter molecular hydrocarbon products. Heavier hydrocarbon feed streams include atmospheric gas oil, vacuum gas oil, FCC light cycle oil, FCC heavy cycle oil, coker light cycle gas oil, or coker heavy cycle gas oil, mixtures thereof which may also include other species therein. The processes typically operate at high pressures (1,000-2,000 psi) and fairly high temperatures (750°-1,500° F., 400-800° C.), in the presence of hydrogen and special catalysts. Typically, both naphtha and diesel products are produced but ethane, propane, butanes and light isoparaffins are also produced. Hydrocracking is normally facilitated by a bifunctional catalyst that is capable of rearranging and breaking hydrocarbon chains as well as adding hydrogen to aromatics and olefins to produce naphthenes and alkanes.

The hydrocracking process depends on the nature of the feedstock and the relative rates of the two competing reactions, hydrogenation and cracking. The primary functions of the hydrogen are to saturate aromatics, prevent polycyclic aromatic compounds from forming, reduce tar formation, bond with impurities to render them more easily separated from the product such as in the case of sulfur and nitrogen compounds to convert them to hydrogen sulfide and ammonia, prevent buildup of coke on the catalyst, and creating diesel with a higher cetane number.

There are a number of commercial catalysts that are characterized as Naphtha Selective Catalysts, Diesel Selective Catalysts and even Flexible Hydrocracker Catalysts. The principle difference seems to be the density and strength of active catalyst acid sites. The more acid sites, the more selective the catalyst is toward naphtha.

With the flexible hydrocracker catalysts, it seems that adjusting the operating conditions to a lower or reduce the reaction temperature enhances the production of diesel yield. In light of that, it has been speculated by the present inventors that if the acid sites of a naphtha-selective hydrocracking catalyst could be temporarily passivated, that naphtha yield would decrease and therefor, diesel yield might actually increase. It turns out that not only is the product slate shifted toward producing more diesel and less naphtha, when more diesel is being made, less methane, ethane and propane are also being produced and a higher percentage of the carbon in the hydrocracker exits in liquid product. With more liquid yield, more diesel yield and even improved pour point properties of the diesel, these are all great results for a refining process.

In the US, most hydrocrackers are operated to produce primarily naphtha as the US uses a high proportion of its motor fuel in the form of gasoline. Moreover, gasoline demand increases in the summer and summer gasoline specifications reduce the effective gasoline production of refineries. During the winter, gasoline demand decreases, supplies tend to increase and diesel, at times, becomes economically attractive in the market place. Refineries with hydrocrackers biased to produce naphtha are not set up to take advantage of this diesel preferred economic opportunity and must continue to produce the less economically attractive gasoline-oriented products.

To produce more diesel, selectively cracking the feed to diesel-range components is desired. Catalyst vendors often provide a portfolio of catalysts that are able to shift the products from naphtha to diesel. Under certain conditions, tests show that diesel yield can increase as much as 25% with a diesel-selective catalyst. However, catalyst replacement requires unit shut down and turnaround which is very costly. Catalyst replacement generally takes place when yields diminish or when the hydrocracker reaches operational limitations (e.g., reactor inlet or outlet temperatures).

One option for increasing diesel yield when using the naphtha-selective hydrocracking catalyst is to reduce the hydrocracking activity by decreasing the reaction temperature. When the reaction temperature was decreased, diesel yield increased, along with the unconverted oil (UCO) yield. UCO can be blended to fuel oil or used as fluid catalytic cracker (FCC) feed at a lower value than diesel. UCO can also be recycled back as hydrocracker feed and further cracked to naphtha or diesel. When the hydrocracker is operating at maximum throughput, the increase in UCO recycle rate will result in a decrease in the rate of the fresh hydrocracker feed which may reduce total refinery throughput and therefore refinery profitability. Therefore, although diesel yield can be increased by decreasing the reaction temperature, the concurrent increase in UCO yield reduces the hydraulic capacity of the hydrocracker and may diminish the economic incentive offered by the high diesel margin.

The hydrocracking catalyst has dual functions: hydrogenation/dehydrogenation by metal/acid sites and cracking by acid sites. A diesel-selective hydrocracking catalyst generally has weaker acidity than a naphtha-selective hydrocracking catalyst. The inventors have recognized that if the acid sites of a naphtha-selective hydrocracking catalyst are partially passivated by basic compounds, diesel yield may be increased. Ammonia which is a basic or alkaline compound, and which is also readily available in a refinery, is often used to characterize catalyst acidity and acid strength by adsorbing/desorbing on the catalyst acid sites. The passivation of the acid sites causes a shift in the ratio of diesel make to naphtha make. More importantly, when the passivation by the addition of basic or alkaline compound is suspended, the product ratio returns to a pre-passivation ratio. Another option for passivation may be a small amount of an amine that is typically available as a liquid in refineries include amines like alkyl-amine compounds, such as tert-Butylamine (TBA), Cyclohexylamine (CHA), Diglycolamine (DGA), Diethanolamine (DEA), Monoethanolamine (MEA), Methyl Diethanolamine (MDEA) and Diisopropanolamine (DTPA).

Turning now to the testing of this inventive process, spiking the hydrocracker with ammonia or ammonia precursor or simply an amine in small amounts can shift the ratio such that more diesel is produced.

Focusing on Table 1 below, sample hydrocracker feed has the following properties:

TABLE 1

| | Properties of hydrocracker feed |
|---|---|
| S (ppm) | 170 |
| N (ppm) | 8 |
| H content (wt %) | 12.98 |
| API gravity | 29.33 |
| SimDis (wt % off) | BP (° F.) |
| IBP | 281.9 |
| 5 | 479.1 |
| 10 | 529.1 |
| 30 | 619.1 |
| 50 | 669.4 |
| 70 | 710.6 |
| 90 | 773.9 |
| 95 | 803.8 |
| FBP | 879.3 |
| Naphtha (0-380° F.) | 1.99 |
| Distillate (380-650° F.) | 39.67 |
| UGO (650+° F.) | 58.13 |
| Composition (wt %) | |
| Paraffins | 24.93 |
| Naphthenes | 46.49 |
| Aromatics | 28.58 |
| Mono-aromatics | 21.63 |
| Di-aromatics | 5.91 |
| Tri-aromatics | 0.98 |
| Tetra-aromatics | 0.05 |
| Iso/normal paraffin ratio | 0.94 |
| Average carbon numbers | 21.38 |
| Average carbon numbers for paraffin | 19.93 |
| Average hydrogen numbers | 36.93 |
| Average molecular weight | 276.12 |

Examples of such feedstocks include as atmospheric gas oil, vacuum gas oil, FCC light cycle oil, FCC heavy cycle oil, coker light cycle gas oil, or coker heavy cycle gas oil. Preferably, at least 50% of the feedstock comprises 650+° F. material.

The feedstock above was provided into a test hydrocracker at the conditions shown in Table 2 below:

TABLE 2

| Catalysts | Catalyst A |
|---|---|
| Temperature (° F.) | Varied |
| Pressure (psig) | 1650 |
| LHSV (hr−1) | 1.5 |
| H2/oil (SCF/BBL) | 5000 |
| NH3 in hydrogen gas (ppm) | 45, 135 |

The hydrocracker was run with the sample feedstock as described above and the following measurements were observed (Table 3 below):

TABLE 3

| Reaction Conditions | | |
|---|---|---|
| $NH_3$ content in hydrogen (ppm) | 45 | 135 |
| Temperature (° F.) | 641 | 659 |

TABLE 3-continued

| Reaction Performance | | |
|---|---|---|
| 650+° F. Conversion (%) | 77.65 | 77.55 |
| $C_{4+}$ liquid yield (vol %) | 115.67 | 115.98 |
| $C_{5+}$ liquid yield (vol %) | 103.82 | 106.03 |
| H consumption (Chemical, SCF/bbl) | 1132 | 1132 |
| $iC_4/nC_4$ | 2.34 | 1.79 |
| Product S (ppm) | 0.8 | 1.5 |
| Product N (ppm) | 0.5 | 0.1 |
| Normalized yield, wt % fresh feed | | |
| $C_1$-$C_3$ | 1.76 | 1.20 |
| $C_4$ | 7.42 | 6.37 |
| Light naphtha ($C_5$-180° F.) | 15.78 | 15.91 |
| Heavy naphtha (180-380° F.) | 43.77 | 43.80 |
| UCO (380+° F.) | 32.96 | 35.05 |
| Diesel (380-650° F.) | 20.25 | 22.28 |
| UGO (650+° F.) | 12.71 | 12.77 |
| Normalized yield, vol % fresh feed | | |
| $C_4$ | 11.51 | 9.88 |
| Light naphtha ($C_5$-180° F.) | 19.34 | 19.49 |
| Heavy naphtha (180-380° F.) | 49.72 | 49.58 |
| UCO (380+° F.) | 34.77 | 36.97 |
| Diesel (380-650° F.) | 21.54 | 23.68 |
| UGO (650+° F.) | 13.23 | 13.29 |

The products from the runs had the following characteristics (Table 4 below):

TABLE 4

| | Diesel | | UCO | |
|---|---|---|---|---|
| Sample ID | No. 1 | No. 2 | No. 3 | No. 4 |
| NH3 in hydrogen (ppm) | 45 | 135 | 45 | 135 |
| Conversion (wt %) | 77.7 | 78.0 | 77.7 | 78.0 |
| Boiling point (° F.) | 380-650 | 380-650 | 380+ | 380+ |
| Density @ 60° F. (g/mL) | 0.8188 | 0.8193 | 0.8258 | 0.8250 |
| API, ° | 41.10 | 41.00 | 39.69 | 39.83 |
| SimDis (wt % off) | BP(° F.) | BP(° F.) | BP(° F.) | BP(° F.) |
| IBP | 316.8 | 326.0 | 331.4 | 332.8 |
| 5 | 377.8 | 373.8 | 387.5 | 383.4 |
| 10 | 394.2 | 390.7 | 407.1 | 399 |
| 30 | 443.9 | 433.3 | 498.9 | 469.6 |
| 50 | 508.8 | 489.1 | 605.6 | 576.5 |
| 70 | 577.6 | 563.9 | 688.2 | 673.5 |
| 90 | 638.7 | 632.1 | 761.4 | 753.4 |
| FBP | 678.7 | 676.2 | 881.2 | 875.6 |
| <380° F. (wt %) | 5.48 | 6.38 | 3.51 | 4.31 |
| >650° F. (wt %) | 6.5 | 5.28 | 39.2 | 34.9 |
| Cloud point (° F.) | 8.4 | 3.6 | 59.5 | 55 |
| Pour point (° F.) | 5.0 | −5.8 | 53.6 | 48.2 |
| Cetane numbers by IQT | 55.5 | 51.7 | 67.7 | 62.1 |
| NOISE composition (wt %) | | | | |
| Paraffin | 42.71 | 40.87 | 51.88 | 46.53 |
| Naphthenes | 50.36 | 50.50 | 44.71 | 46.40 |
| Aromatics | 6.93 | 8.63 | 3.41 | 7.06 |
| Mono-aromatics | 6.80 | 8.46 | 3.40 | 6.85 |
| i/n paraffin | 3.04 | 3.12 | 1.74 | 2.14 |
| Average C numbers | 15.18 | 14.78 | 17.36 | 17.20 |
| Average H numbers | 30.14 | 29.20 | 35.07 | 34.32 |
| Average MW | 212.26 | 206.56 | 243.41 | 240.66 |

Table 3 shows the reaction performances and product slates with 45 and 135 ppm NH3 in hydrogen gas. The 45 ppm $NH_3$ case is to mimic refinery conditions for a second-stage hydrocracker. This 45 ppm of ammonia is about the content that passes through pre-treater and exists in the feedstock. In tests for comparison, 45 ppm ammonia is added to simulate the expected conditions and the 135 ppm is found to be a total ammonia content that will perform the desired passivation of the acid sites to shift the product slate toward a diesel bias. So, at 45 ppm ammonia content, the diesel yield increased from 21.5 vol % for 45 ppm $NH_3$ content to 23.7 vol % when the spiking was raised to 135 ppm $NH_3$ content. Yields for other liquid products, including light naphtha, heavy naphtha, and UCO, were almost the same, while the yields for $C_1$-$C_4$ gas products decreased. Therefore, total $C_{5+}$ liquid yield also increased by 2.2 vol %. The increase in diesel (or $C_{5+}$ liquid) yield mainly resulted from the reduction in gas yields.

Table 4 compares the properties of diesel and UCO produced with 45 ppm and 135 ppm $NH_3$ in hydrogen gas. The cloud point and pour point of diesel and UCO were both improved by increasing the $NH_3$ content in hydrogen gas from 45 to 135 ppm. The improvement in cloud point and pour point for the diesel fraction suggested that the diesel yield could be further increased by extending the diesel end cut point. The improvement in cloud point and pour point for UCO indicated that the amount of UCO to be blended to diesel pool might be increased. As expected, cetane numbers for diesel and UCO deceased when the $NH_3$ content in hydrogen gas increased from 45 to 135 ppm. Nevertheless, cetane numbers for diesel and UCO were still much higher than the D975 diesel specification of 40.

What should be seen in these two tables is that spiking $NH_3$ to a higher-level increases overall liquid yield, diesel yield and improves the diesel's cold flow property.

Catalyst performance comparison before and after high $NH_3$ exposure (Table 5)

TABLE 5

| Reaction Conditions | Before NH3 spiking commences | After NH3 spiking ceases |
|---|---|---|
| Temperature (° F.) | 642.4 | 648.1 |
| Reaction Performance | | |
| C4+ liquid yield (vol %) | 116.14 | 113.92 |
| C5+ liquid yield (vol %) | 104.46 | 102.25 |
| H consumption (Chemical, SCF/BBL) | 1165 | 1129 |
| iC4/nC4 | 2.35 | 2.35 |
| Liquid Product Properties | | |
| Density @ 60° F. (g/mL) | 0.7802 | 0.7804 |
| H content (wt %) | 14.44 | 14.35 |
| S (ppm) | 0.8 | 0.8 |
| N (ppm) | 0.4 | 0.2 |
| Normalized yield, wt % fresh feed | | |
| C1-C3 | 1.84 | 2.26 |
| C4 | 7.62 | 7.61 |
| Light naphtha (C5-180° F.) | 16.31 | 17.68 |
| Heavy naphtha (180-380° F.) | 45.21 | 42.06 |
| UCO (380+° F.) | 31.41 | 31.06 |
| Diesel (380-650° F.) | 19.58 | 19.23 |
| UGO (650+° F.) | 11.83 | 11.83 |
| Normalized yield, vol % fresh feed | | |
| C4 | 11.68 | 11.67 |
| Light naphtha (C5-180° F.) | 19.99 | 21.66 |
| Heavy naphtha (180-380° F.) | 51.35 | 47.77 |
| UCO (380+° F.) | 33.12 | 32.82 |
| Diesel (380-650° F.) | 20.82 | 20.50 |
| UGO (650+° F.) | 12.30 | 12.32 |

Table 5 compares the reaction performance and product slates for catalyst A before and then after exposure to the elevated $NH_3$ content (135 ppm) at a normalized conversion of 80%. The $NH_3$ content in hydrogen gas was 45 ppm for both tests. The catalyst has been exposure to high $NH_3$ concentration for ~2 months. The results indicate that the catalyst recovered its activity when the $NH_3$ content in hydrogen gas dropped from 135 ppm $NH_3$ back down to 45 ppm $NH_3$. However, the temperature required for 80% conversion after exposure to high $NH_3$ content was higher than that required before the exposure to high $NH_3$ concentration which suggests that the cost of spiking the ammonia might be in the shorter life of the catalyst. So, while this invention provides a new "knob" for producing more diesel in a diesel favorable price circumstance, it may be at some run time consideration for the catalyst load.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for operating a catalytic hydrocracker in a hydrocarbon refinery wherein the process comprises:

selecting and installing a catalyst into a hydrocracker vessel where the catalyst has a characteristic for high naphtha selectivity;

delivering a hydrocarbon feedstream into the hydrocracker vessel where the hydrocarbon feedstream comprises a heavy distillation hydrocarbon material where at least 50% of the feedstream has a boiling point fraction of at least 650° F.:

delivering hydrogen into the hydrocracker vessel where both the hydrocarbon feedstream and the hydrogen are in contact with the catalyst under catalytic conditions to cause both hydrogenation and cracking of the hydrocarbon feedstream;

producing a product slate that comprises a first desired naphtha make and a first desired distillate make;

selectively feeding a basic compound in to the hydrocracker to partially passivate the catalyst and to thereby shift the product slate to a ratio where a higher diesel make is produced relative to the naphtha make such that the diesel make is at least 0.5% higher than when the basic compound is not fed to the hydrocracker; and selectively suspending the feed of the basic compound to the hydrocracker to shift the product slate back to near the original ratio of diesel make to naphtha make.

2. The process according to claim 1 wherein the higher diesel make is at least 1% higher than the diesel make prior to the step of selectively feeding the basic compound.

3. The process according to claim 1 wherein the basic compound is ammonia.

4. The process according to claim 1 wherein the basic compound is a precursor for ammonia that forms in the hydrocracker under the catalytic conditions of the hydrocracker.

5. The process according to claim 1 wherein the basic compound is an ammine.

6. The process according to claim 5 wherein the amine is an alkyl-amine, such as tert-Butylamine (TBA).

7. The process according to claim 5 wherein the amine is an alkyl-amine, such as Cyclohexylamine (CHA).

8. The process according to claim 5 wherein the amine is Diglycolamine (DGA).

9. The process according to claim 5 wherein the amine is Diethanolamine (DEA).

10. The process according to claim 5 wherein the amine is Monoethanolamine (MEA).

11. The process according to claim 5 wherein the amine is Methyl Diethanolamine (MDEA).

12. The process according to claim 5 wherein the amine is Diisopropanolamine (DTPA).

13. The process according to claim 1 wherein the hydrocarbon feedstream comprises one or more of atmospheric gas oil, vacuum gas oil, FCC light cycle oil, FCC heavy cycle oil, coker light cycle gas oil, or coker heavy cycle gas oil.

14. The process according to claim 1 wherein the hydrocarbon feedstream comprises at least 90% by weight species with a boiling point above 500° F.

15. The process according to claim 1 wherein the higher diesel make is at least 2% higher than the diesel make prior to the step of selectively feeding the basic compound.

16. The process according to claim 1 wherein the higher diesel make is at least 5% higher than the diesel make prior to the step of selectively feeding the basic compound.

17. The process according to claim 1 wherein the higher diesel make is at least 7% higher than the diesel make prior to the step of selectively feeding the basic compound.

18. The process according to claim 1 wherein the higher diesel make is at least 8% higher than the diesel make prior to the step of selectively feeding the basic compound.

19. The process according to claim 1 wherein the higher diesel make is at least 9% higher than the diesel make prior to the step of selectively feeding the basic compound.

* * * * *